US005765956A

United States Patent [19]

Lanzarin

[11] Patent Number: 5,765,956

[45] Date of Patent: Jun. 16, 1998

[54] DEVICE FOR PERFECTED CLOSURE OF THE MECHANISM HAVING FLAT RINGS FOR CONTAINERS OF MOBILE SHEETS

[76] Inventor: Giuseppe Lanzarin, Via Divisione Julia, 39, Vicenza, Italy

[21] Appl. No.: 724,765

[22] Filed: Oct. 3, 1996

[30] Foreign Application Priority Data

Oct. 12, 1995 [IT] Italy ..... VI95A0160

[51] Int. Cl.[6] ..... B42F 13/00

[52] U.S. Cl. ..... 402/26; 402/39

[58] Field of Search ..... 402/26.4, 31.45, 402/39; 281/19.2, 27.1, 28

[56] References Cited

U.S. PATENT DOCUMENTS 2,460,718 2/1949 Stevens ..... 402/26

2,716,985 9/1955 Wolf ..... 402/4

*Primary Examiner*—Willmon Fridie, Jr.

*Attorney, Agent, or Firm*—Buckman and Archer

[57] ABSTRACT

The perfected closure device comprises rings (2) and screws (3) which are formed with a single presswork operation together with the strip (1) to be placed at the disposal of the user. The latter with a simple coin screws screws (3) within suitable orifices formed on strip (1), the latter being fixed to the internal surface of the folder. There is also provided that each ring (2) may be closed simply by causing projections (5) which are formed on the base of each ring to penetrate within shaped grooves (4), the latter being formed at the opposite end of the same ring, an operation which is easy due to the elasticity of the material which constitutes the rings.

6 Claims, 3 Drawing Sheets

DEVICE FOR PERFECTED CLOSURE OF THE MECHANISM HAVING FLAT RINGS FOR CONTAINERS OF MOBILE SHEETS

FIELD OF THE INVENTION

The present invention relates to a device for the closure of the rings in a loose leaf folder.

BACKGROUND OF THE PRIOR ART

A device has been described which has removable flat rings for containers of mobile sheets. This device comprises a supporting strip which is fixed by means of rivets on one of the faces of the folder and a plurality of mobile rings which are fixed to the strip to permit the containment of documents to be kept in the folder by providing that each mobile ring be provided with tongues which emerge from the rectilinear section of which the ring is provided. The ring is elastically hookable to projections which emerge within the cavity formed along the sides of the supporting strip in order to hold the rings in the folder when the folder is not used.

The same device provides that one open end of the ring had projections which hooked themselves to the opposite end of the same ring and a notch is provided in the interior of the tooth which made the projection elastic in order to allow the introduction within the cavity and its enlargement in the interior of the cavity after the ring was closed.

SUMMARY OF THE INVENTION

According to the present invention, there is provided that the base strip of the closure device is fixed in the interior of one of the faces of the folder by means of screws instead of rivets by the user who removes the screws made of plastic material from the base strip for the purpose of screwing the screws in the threaded openings which are provided along the internal face of the folder by means of a simple coin which acts along the head of the screw which is accessible from the external part.

In addition, there are no side notches along the strip because the rings and the screws are formed with a single operation of presswork of the plastic material together with the base strip. In addition, there is provided the possibility of recovering the closure device by the same user when the folder is discarded, for instance when the user arranges for the folder to be destroyed while the device is used again with new folders which obviously are provided with orifices disposed in suitable positions.

BRIEF DESCRIPTION OF THE DRAWINGS

The device is better explained hereinbelow by reference to the accompanying drawings of which

As shown in FIG. 1, the rings (2) are connected with the base strip (1) because they are formed by presswork. Rings (2) obviously are in the open position. FIG. 1 also shows the screws (3) which are necessary for fixing the strip (1) along the internal wall of one of the faces of the folder.

Figure 1:
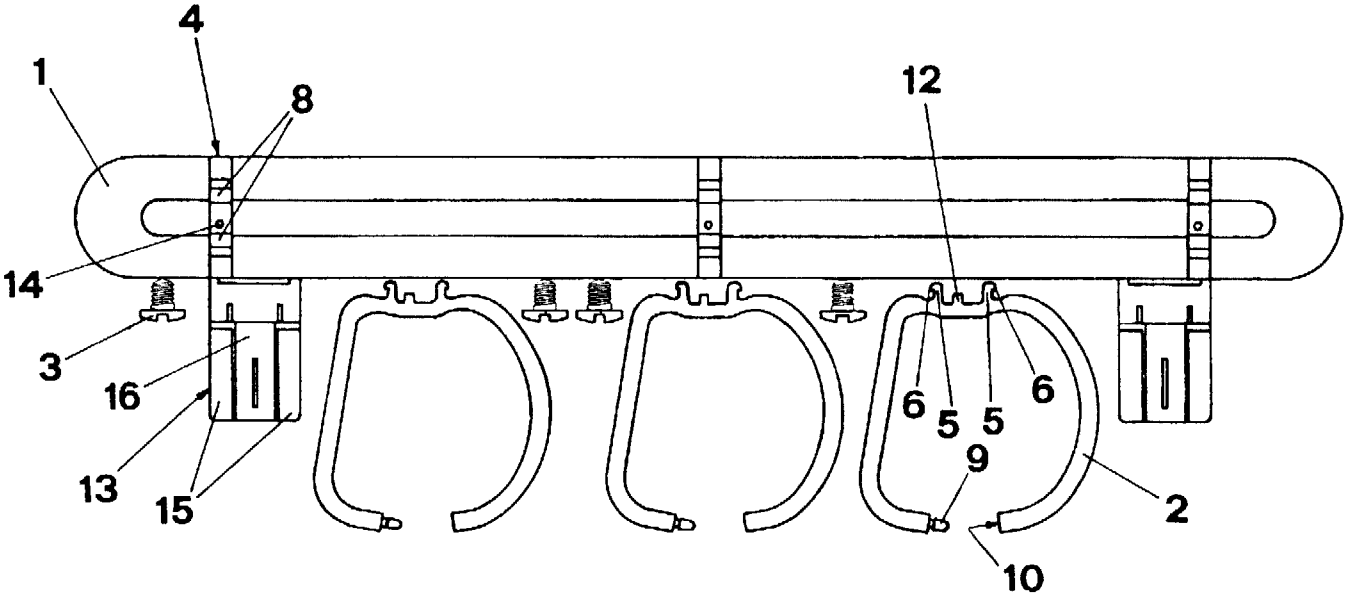
FIG. 1 shows the total view of the strip with the rings and the screws which are formed with a single presswork operation.

Obviously along strip (1) are formed grooves (4) and tongues (5) emerge from the base of the ring (2) forming a tooth (6) which emerges towards the exterior. The tongues (5) hook themselves to the openings (8) which are formed along strip (1) at the time when the device is put together, remaining always in this position hooked to the same base strip (1) both prior and after the closure operation of the ring (2) exactly in the same manner as described in the cited patent application.

Projection (12) emerges from the base of ring (2), the projection being advantageously located in a position asymetrical with respect to the two tongues (5) and penetrates within a suitable orifice (14) formed on the base strip (1) for the purpose of preventing the inverted insertion of the ring (2) in the same base.

Sealing members (13) emerge from the base (1). They are separable and comprise two lateral lowered tongues (15) and a central tongue (16) which is raised so that they allow the entire device to be fixed to the folder during the phase when the device is being sold.

In actual practice, since the folders may be sold without any packing, the sealing members (13) do not allow the separation of base (1) from the folder.

Figure 2:
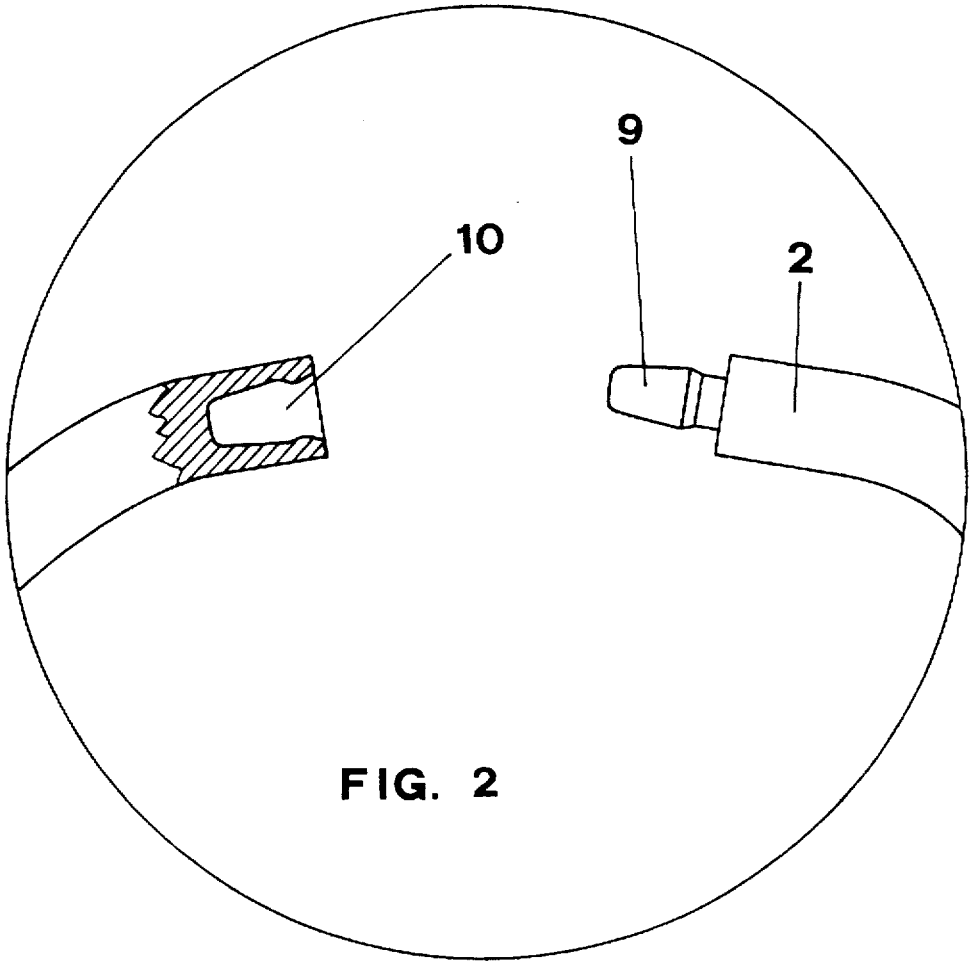
FIG. 2 shows the particular section of the extremity of one of the closure rings in the open position.

The closure operation of the ring (2) is carried out by inserting the truncoconical projection (9) within the cavity (10), as shown in FIG. 2. The latter is suitably shaped so that the insertion is carried out easily due to the elasticity of the material of which the same projection is made without the requirement of particular cut-out portions.

Figure 3:
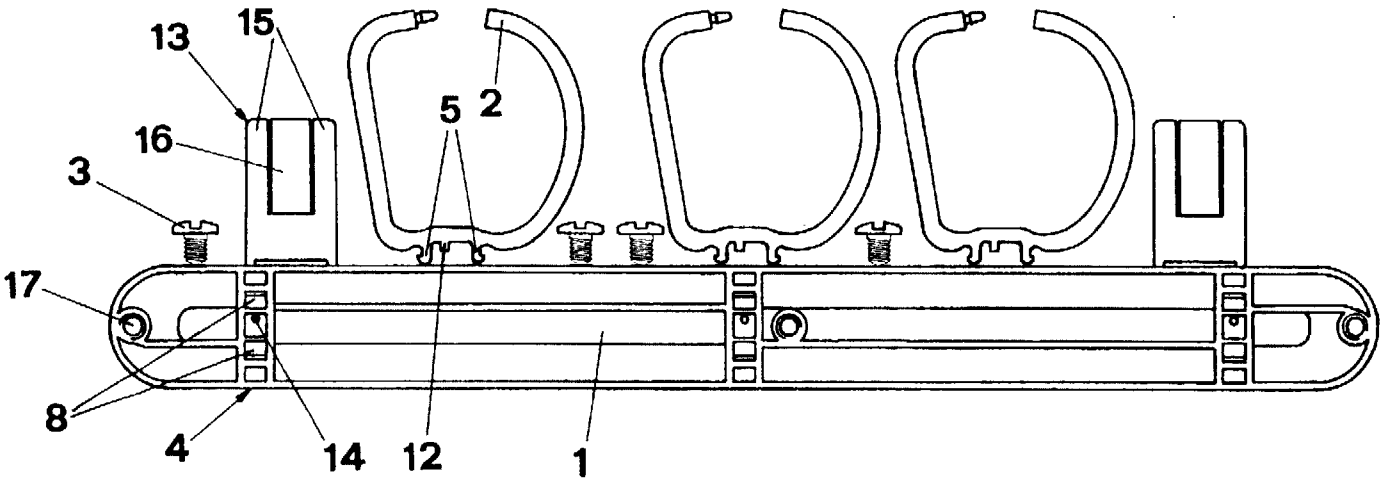
FIG. 3 shows the rear view of the strip.

FIG. 3 shows clearly the surface of the strip (1) which rests itself on the folder and one will note the existence of blind orifices (17) which are threaded, within which one screws the screws (3). These screws go through the orifices formed in the folder in order to fix the strip in a permanent manner to the folder. The screws (3) and the rings (2) are fixed at the time when the material is given to the user to the strip (1) and they are easily removable by the user prior to use.

Figure 4:
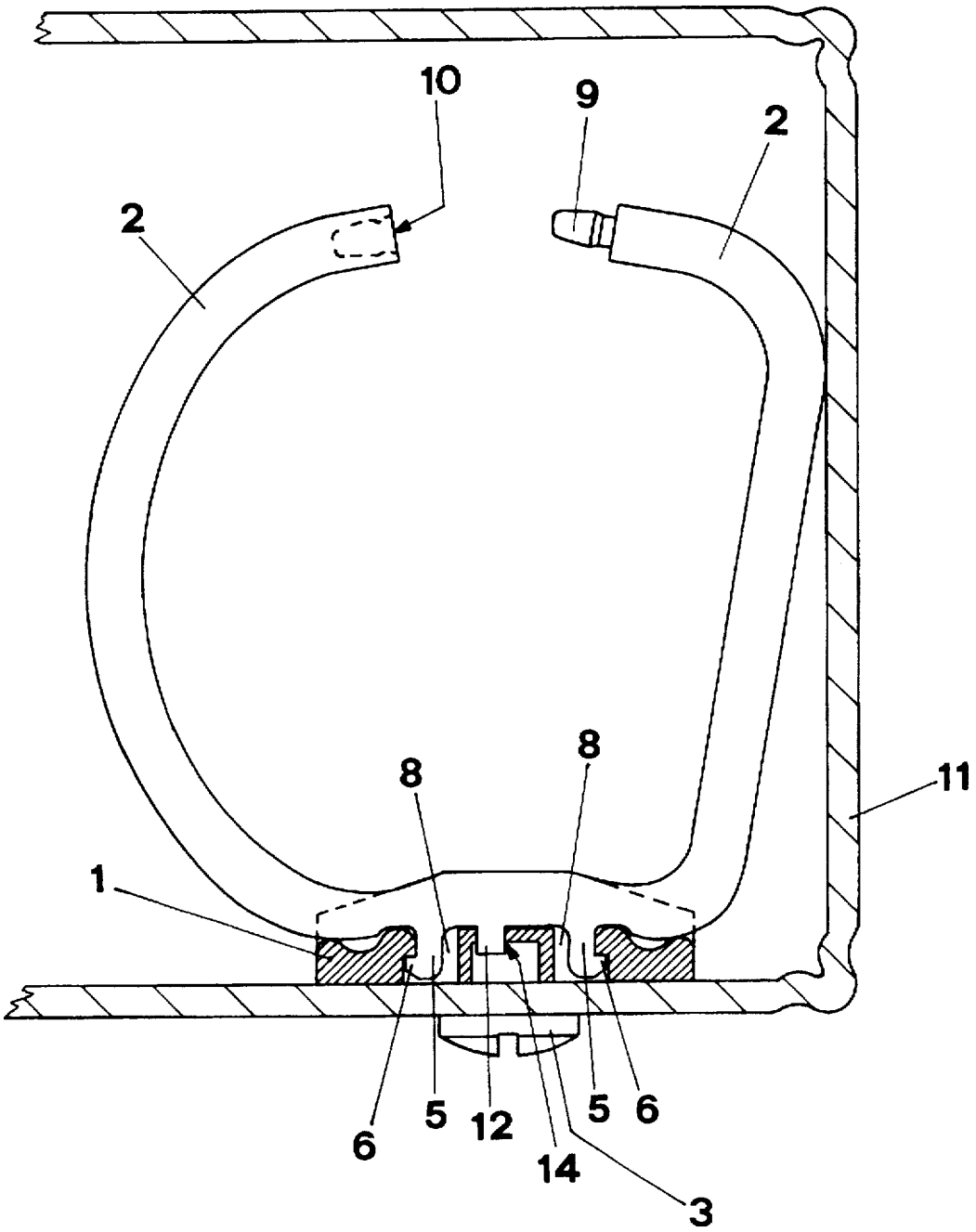
FIG. 4 is a side view of the device used for hooking with the base strip in cross section.

FIG. 4 shows that in actual practice the tongues (5) are provided with teeth (6), emerge towards the exterior and hook themselves into the openings (8) formed on the strip (1).

In addition FIG. 4 shows that projection (12) is disposed in an asymetrical position and penetrates into the orifice (14) with the advantages previously described.

Obviously as already mentioned hereinabove, the entire closure device may be used over again when the folder is sent to be destroyed simply by unscrewing the screws (3) and using again the same device in a new folder which is provided independently from the device.

All these particular details are possible according to the improvements of the closure of the present invention which shows among others the advantages both from an aesthetic point of view by elimination of the slit on one of the ends of the ring and also from a practical point of view for the greater ease of insertion of the projection within the cut-out portion as well as from an economical point of view with respect to the cost of manufacture, a fact which may allow obviously also a reduction of the sale price of the same device.

Naturally the constructive details of the device described herein and illustrated in the accompanying figures may assume other forms and other appearances while maintaining constant the essential characteristics of the invention without departing from the scope of the invention.

What is claimed is:

1. A device for the closure of the rings in a folder (11) for containing mobile sheets wherein the folder has an internal surface and orifices in said internal surface, the device comprising a shaped strip (1), open rings (2), screws (3), said open rings and screws being connected to said strip, said strip resting on said folder, said strip having grooves (4), each of said rings (2) having two ends, at one end having a projection (9), at the opposite end having a properly shaped groove (10), each of said projections (9) penetrating at the time when the ring is closed within each of said shaped grooves (10), said screws (3) penetrating within said orifices formed in said internal surface of the folder, said strip having blind threaded orifices (17), said screw engaging with said threaded orifices when the strip is fixed to said folder.

2. The device according to claim 1 wherein each of said rings (2) has two tongues (5) in the portion of said rings opposite to the two ends of said rings, each of said tongues (5) forming a tooth (6), said strip (1) having openings (8), each of said tongues engaging with each of said openings when the device is assembled.

3. The device according to claim 1 wherein each of said rings has a projection (12) located between said tongues (5), and asymmetrical with respect to said tongues (5), said strip (1) has orifices (14), each of said projections penetrating within said orifices (14).

4. The device according to claim 1 wherein said strip has two ends, each of said ends having a sealing element (13), said sealing element having a central tongue (16) and another tongue (15) at the bottom thereof, said tongues being fixed to said folder (11) when the device is connected to the folder.

5. The device according to claim 1 wherein each of said projections (9) is truncoconical and said ring has a cavity (10) at the other end, each of said projections (9) engaging with each of said cavities when each of said rings is closed.

6. The device according to claim 1 wherein said strip, said rings and said screws are manufactured with a single press-work operation.

* * * * *